United States Patent [19]

Beale et al.

[11] Patent Number: 4,805,408

[45] Date of Patent: Feb. 21, 1989

[54] STIRLING ENGINE POWER REGULATION SYSTEM

[75] Inventors: William T. Beale; David M. Berchowitz, both of Athens, Ohio

[73] Assignee: Sunpower, Inc., Athens, Ohio

[21] Appl. No.: 67,002

[22] Filed: Jun. 29, 1987

[51] Int. Cl.[4] ..... F02G 1/04; F02G 1/06

[52] U.S. Cl. ..... 60/520

[58] Field of Search ..... 60/520, 522

[56] References Cited

U.S. PATENT DOCUMENTS 4,458,495 7/1984 Beale ..... 60/520 X 4,583,364 4/1986 Wood ..... 60/520

4,622,813 11/1986 Mitchell ..... 60/522

*Primary Examiner*—Allen M. Ostrager

*Attorney, Agent, or Firm*—Frank H. Foster

[57] ABSTRACT

The power output of a free piston Stirling engine is regulated by a valve in the gas flow path from the cold space through the regenerator to the hot space. The valve causes restriction of the gas flow path as in response to piston excursion beyond a selected excursion amplitude. Increased excursion causes increased restriction. The result is that, for piston excursions beyond the selected amplitude, the power out diminishes for increased stroke making the engine stable with any load from zero to maximum and avoiding runaway.

11 Claims, 2 Drawing Sheets

STIRLING ENGINE POWER REGULATION SYSTEM

TECHNICAL FIELD

This invention relates generally to free piston Stirling engines which directly convert heat energy into reciprocating mechanical energy and more particularly the invention relates to a system for regulating the output power of a free piston Stirling engine in order to stabilize it and prevent damage under varying loads.

BACKGROUND ART

The free piston Stirling engine has characteristics which make it particularly suitable and advantageous for use in many applications. Such engines are capable of driving a variety of loads and commonly are used to drive linear alternators so that heat energy from the combustion of fuels or from the sun can be used to generate electrical energy.

Typically the engine is designed to operate at a selected operating temperature and to supply a selected operating or maximum load power. For example, the engine may be designed to drive a linear alternator which supplies an electrical load. So long as the power demand of the electrical load remains constant at the design value, the free piston Stirling engine, which is an oscillator, remains in dynamic equilibrium and operates at the design output power, stroke amplitude and temperature.

Problems arise, however, when the equilibrium conditions are changed, for example by a reduction in the power demand of the electrical load. This reduction may be the result of reduced work demand or disconnection of the electrical load. If the engine is not provided with any power regulation, a reduction in the power demand of the alternator or other load on the engine will cause the strokes of the power piston and the displacer of the Stirling engine to increase. With insufficient load connected to absorb the excess available output power, the piston excursion amplitudes will increase until this "runaway" causes the piston and displacer to collide with each other and/or collide with other parts within the Stirling engine resulting in damage or destruction of the Stirling engine.

FIG. 4 illustrates the problem. FIG. 4 is a graph of Stirling engine power output versus piston displacement for a conventional engine. A Stirling engine operating at temperature $T_1$ will exhibit a power out versus displacement characteristic curve $T_1$. If the engine is connected to a load, such as a linear alternator, the load will have a characteristic curve illustrated as $L_1$, which may, for example, be the design or maximum load on the alternator.

If the unregulated engine is started and an electrical load is supplied from the alternator, the piston stroke or maximum excursion amplitude will increase until equilibrium is reached at operating point $O_1$. If the power output demand is reduced delta P while engine temperature remains at $T_1$, the piston displacement will continue increasing because the excess energy will not be absorbed by the load. This instability causes a runaway condition because increased stroke results in even more unabsorbed energy output resulting in the ultimate damage or destruction of the Stirling engine and possibly the alternator.

If the engine temperature could be instantaneously reduced to temperature $T_2$, then a new equilibrium operating point $O_2$ could be reached at the reduced load $L_2$. However, the mass of the Stirling engine prevents the instantaneous change of engine temperature and therefore under transient conditions, runaway will occur in an unregulated free piston Stirling engine.

A related problem occurs if a free piston Stirling engine is driving a load which undergoes a brief pause or interruption in its operation caused, for example, by a temporary overload. Under these conditions the engine oscillation may stop. Even a stop of short duration will cause the temperature of the engine to increase since the heat input energy is no longer being absorbed by the load or transferred to the cooler. When the engine restarts at a higher temperature, it will operate under a temperature curve which is higher than the temperature curve $T_1$. Thus, a similar runaway condition will occur. Although the runaway condition may only be momentary, it may be sufficiently long that the engine will be damaged before its temperature can fall down to its design operating temperature $T_1$.

Yet another problem is that the instability of the unregulated engine, which causes it to run away when there is no output power demand, requires that a Stirling engine either be started under load or started at a very low temperature in order to prevent immediate run away. Under load the engine is more difficult to start.

One solution of these problems is to provide an external variable load which absorbs the excess power when the power demand of the load is reduced. This is the subject of U.S. Pat. No. 4,642,547.

Yet another proposed solution to this problem is to electrically drive the displacer of the Stirling engine at a controlled excursion amplitude. In this system the displacer is driven by an electrical drive mechanism, typically a linear motor. The stroke of this linear motor drive is controlled by a control system. Displacer stroke is reduced when the power output demand is reduced and similarly is increased when the power output demand is increased.

The problem with this system is that it is far too complicated and expensive, requiring substantial control apparatus and additional external connections to the Stirling engine. This solution also exhibits transient problems since a finite time is required for such a system to respond to a variation in load power demand.

BRIEF DISCLOSURE OF INVENTION

In the present invention a valve means is placed in the gas flow path which extends from the hot space, adjacent one end of the displacer, through a regenerator to the cold space adjacent the opposite end of the displacer. This valve means is connected to a means for detecting the excursion of the piston beyond a selected first amplitude. The valve means restricts the working gas flow path between the hot space and the cold space in response to piston excursion beyond the selected amplitude. Thus, as the piston amplitude increased beyond the selected amplitude, the gas flow path is increasingly restricted, which results in a reduction of the displacer excursion amplitude. Reduction of the displacer amplitude causes a reduction in the power output of the Stirling engine.

Figure 1:
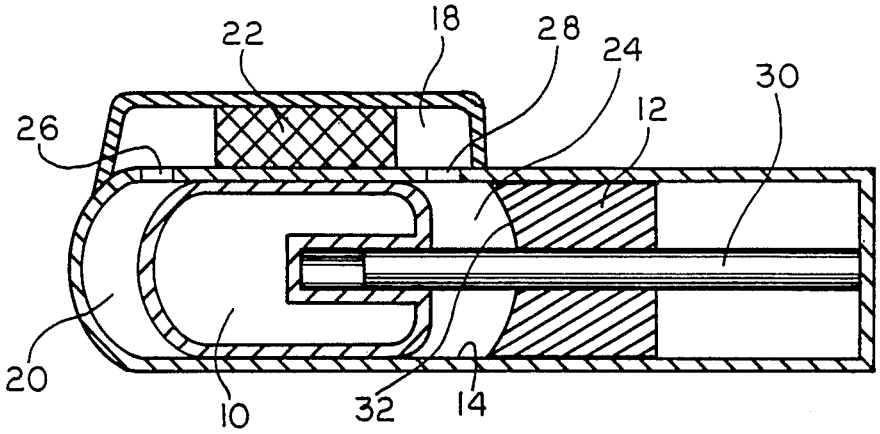
FIG. 1 is a diagrammatic view in section of a free piston Stirling engine embodying the present invention.

In describing the preferred embodiment of the invention which is illustrated in the drawings, specific terminology will be restored to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 is a diagrammatic view illustrating a free piston Stirling engine which has a displacer 10 and a piston 12 reciprocating in a cylinder 14, formed in a housing 16. The Stirling engine has a working gas flow path 18 which extends from the hot space 20, to which heat energy is input, through a regenerator 22 to a cold space 24 from which heat energy is removed in the conventional manner. The working gas flow path has one end at a hot port 26, formed through the cylinder wall 14, and its other end at a cooler port 28, also formed through the cylinder wall 14. The displacer 10 and the piston 12 reciprocate on the rod 30 in the conventional manner and the power is taken off from the piston 12 in a conventional manner not illustrated.

The preferred embodiment of the present invention has a valve in the working gas flow path. The preferred valve means is formed by a valve which is in the nature of a spool valve. This valve means is formed by positioning the cooler port 28 in the cylinder wall so that it is intercepted by the end 32 of the piston 12 at a selected first piston amplitude. This cooler port 28 is positioned so that the end 32 of the piston begins to intercept the port 28 at the position along the characteristic curve of the Stirling engine at which the designer wishes to begin reducing the power output below that which it would be without the present invention or any other power regulation.

As the piston excursion amplitude progresses beyond this selected first amplitude, the port is further restricted as a function of piston position. This, in turn, further reduces the engine power output.

The amount of piston travel beyond the selected first ampltiude which will ultimately cause complete blockage of the port 28 is determined by the axial dimension of the port 28.

When the cooler port 28 is restricted, the displacer is impeded in its reciprocation because the working gas which the displacer must push back and forth between the hot space and the cold space is restricted in its passage through the working gas flow path by the restriction at the cooler port 28. The result is that the displacer is caused to do more work in pushing the gas through the restriction and thus its amplitude of oscillation is decreased as the restriction becomes greater, that is more restricted.

Figure 4:
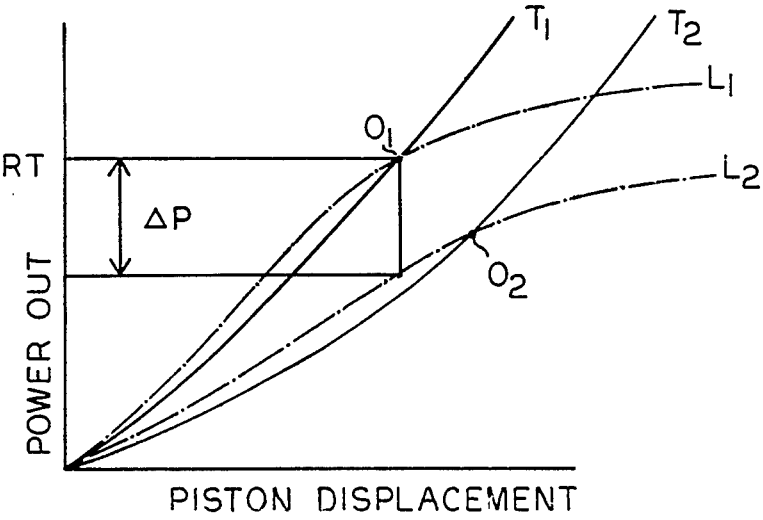
FIG. 4 is a graphical plot of characteristic curves of a free piston Stirling engine connected to a linear alternator and operating in accordance with the prior art.
Figure 5:
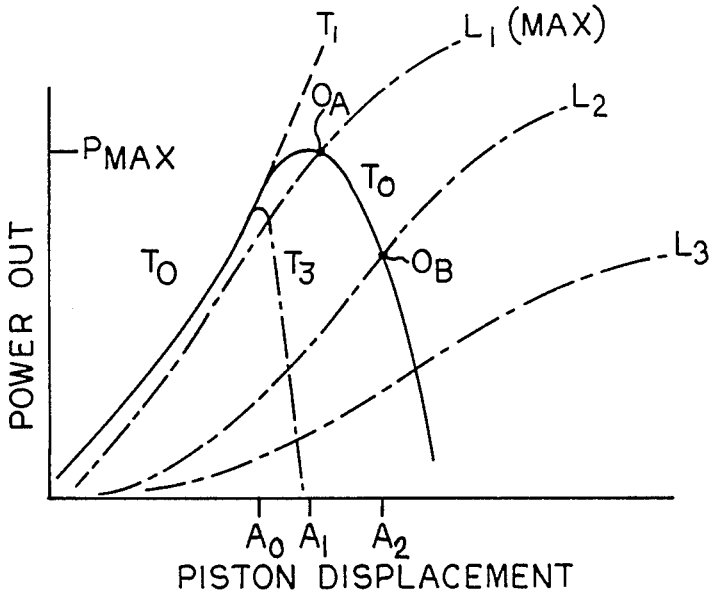
FIG. 5 is a graphical plot of characteristic curves of a free piston Stirling engine connected to a linear alternator and operating in accordance with the present invention.

The effect of the restriction by the valve means is illustrated in FIG. 5. THe characteristic curve $T_0$, is solid black line, respresents the power out versus piston displacement characteristic curve for a free piston Stirling engine operating in accordance with the present invention. At lower piston displacement it is identical to the curve $T_1$ of FIG. 4 which is shown extended in a dashed line. However, at piston displacement $A_0$, the selected first ampltiude, the characteristic curve for the present invention deviates from the characteristic curve of an unregulated Stirling engine and deviates further as the piston intercepts the cooler port 28. For increasingly more restriction of the cooler port 28, the characteristic curve bends downwardly for reduced power output as stroke increases beyond amplitude $A_0$.

A free piston Stirling engine embodying the present invention may be designed to have its maximum power output $P_{max}$ occur at a stroke or piston displacement $A_1$ which is substantially at the peak of curve $T_O$. Thus, upon initiation of the operation of the Stirling engine, its stroke and power output can rise no higher than the peak and under maximum load will rise to the peak and operate at operating point $O_A$ along the curve $L_1$ shown in phantom line as the alternator operating characteristic at maximum load.

Any reduction in the power demand of the load will result in an increased piston excursion amplitude and reduced power. For example, if the load demand is reduced to load $L_2$, the stroke will increase to $A_2$ and operation will continue at operating point $O_B$. Further power output reductions, such as to no load, will result in further, but slight increase in excursion amplitude and substantially reduced power as the working gas flow passage becomes more and more restricted.

Thus, the present invention causes the free piston Stirling engine to exhibit the unusual characteristic that engine power output is reduced as its stroke is increased beyond the selected amplitude. Since alternator power increases with alternator stroke, the engine is always operating at a stable equilibrium.

The sharpness of the drop of the characteristic curve for engine operation is a function of the piston displacement required for the working gas flow path to go from unrestricted to completely restricted; that is, it is a function of the rate with respect to piston amplitude at which the cooler port 28 is restricted. As the axial dimension of the port is made less, the port closes more rapidly as a function of piston displacement and the curve becomes sharper. A sharp curve $T_3$ is illustrated in FIG. 5 for a cooler port 28 having a relatively short axial dimension.

Figure 6:
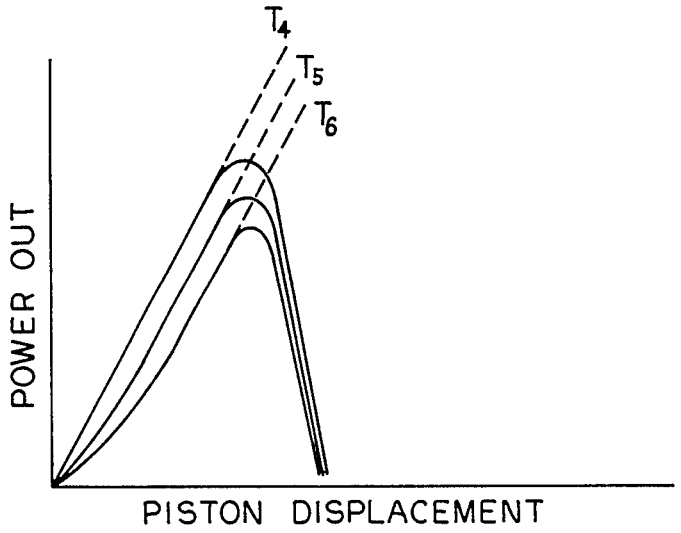
FIG. 6 is a graphical plot of operating characteristic of a free piston Stirling engine at different temperatures and embodying the present invention.

FIG. 6 illustrates a family of curves for free piston Stirling engines embodying the regulation system of the present invention for different temperatures $T_4$, $T_5$, and $T_6$.

Figure 7:
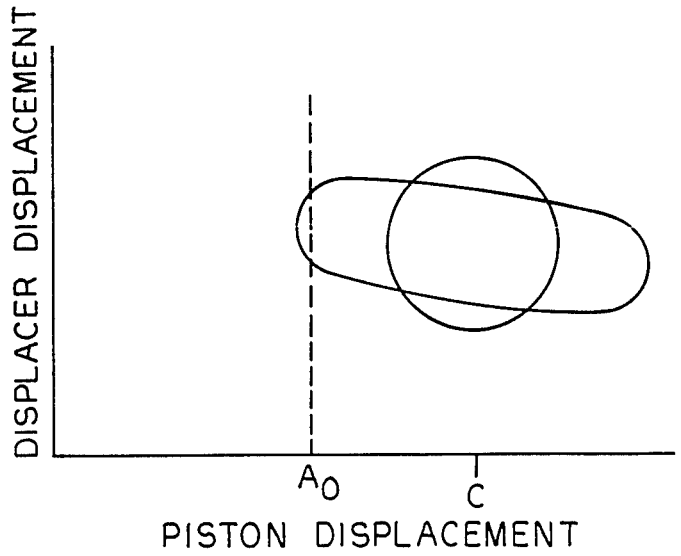
FIG. 7 is a graphical plot of the piston displacement versus displacer displacement of a Stirling engine embodying the present invention.

FIG. 7 illustrates the relative phasing of the piston and displacer in an embodiment of the present invention. Curve 40 shows the relatively circular, typical, characteristic of a free piston Stirling engine when the cooler port 28 is not intercepted and the displacer and piston are operating in a conventional mode. As piston and displacer displacement increase, this relatively circular curve exhibits a larger and larger diameter until the piston intercepts the cooler port 28 at selected first amplitude $A_O$. As the displacer displacement exceeds the selected first amplitude $A_O$, the curve becomes more elliptical, as illustrated at 42. Its vertical dimensions are reduced due to reduction in displacer displacement and its horizontal dimensions are enlarged slightly as piston displacement increases slightly.

Figure 2:
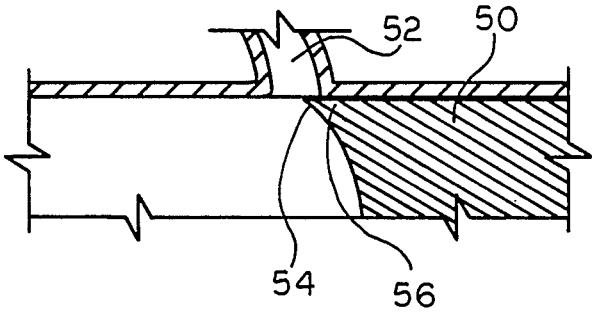
FIG. 2 is a diagrammatic view in section of a segment of an alternative engine embodying the present invention and illustrating a portion of the piston and the cooler port leading from the cold space to the regenerator.
Figure 3:
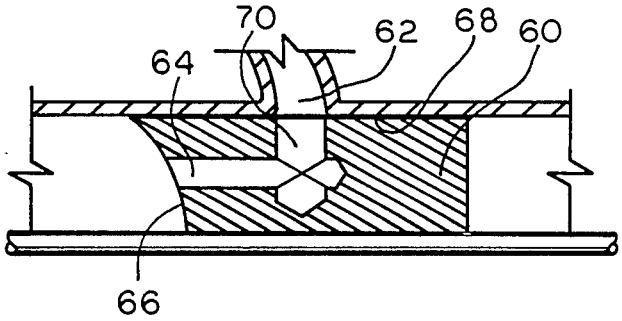
FIG. 3 is a diagrammatic view in section similar to the view of FIG. 2, but showing yet another alternative embodiment of the invention.

FIG. 2 and FIG. 3 illustrate alternative embodiments of the invention. FIG. 2 illustrates another way the curvature of the Stirling engine characteristic curve for the present invention may be controlled by the designer. FIG. 2 illustrates a piston 50 and a cooler port 52. The piston is formed with a sharp skirt 54. Such a sharp skirt will cause tubrulent gas flow and a sharp cut off, thus sharpening the decline of the characteristic curve below that for an unregulated Stirling engine. Alternatively, the skirt may be rounded, as shown in phantom at 56, to provide an aerodynamically smoother cut off and a more rounded drop of the characteristic curve.

FIG. 3 illustrates a piston 60 and cooler port 62. A passageway 64 is formed through the piston from its end 66 through its sidewall 68. The cooler port 62 is formed through a wall of the cylinder and is axially positioned to be in registration with the piston port 70 at the intermediate position of the piston 60. The ports 62 and 70 are axially dimensioned so that restriction of the gas flow through the ports occurs when the piston exceeds the first selected excursion amplitude. The designer has considerable design parameters available in the form of the axial dimension of the port 62 and 70 which may be effectively extended by appropriate axial slots or grooves.

As illustrated in FIG. 1, it is desirable to form the interfacing ends of the displacer and the piston with matingly contoured surfaces so that they can operate with maximum efficiency. Since displacers are commonly hollow and therefore dome-shaped in order to minimize their mass, it is desirable to form the end of the piston facing the displacer in a mating, concave, contour.

In accordance with the present invention it is also possible to form the valve means by positioning the cooler port so that it is intercepted by the displacer rather than the piston. Similarly, other mechanical structures can be utilized to detect the position of the piston or the position of another structure which has a position related to the dispalcer in order to detect the excursion of the piston beyond the selected first amplitude. For example, a plunger rod or lever could extend into the cylinder or be connected to the piston in a variety of ways which will be obvious to those skilled in the art from this description, and in turn connected to a separate valve positioned any where in the working gas flow path to accomplish the same purpose and operation described above. This can be done with electrical, mechanical or hydraulic systems for example.

Because the present invention causes the engine characteristic curve to bend downwardly and thus a higher stroke produces a lower power output, an engine which is regulated in accordance with the present invention may be started when hot and may be started under no load conditions and can never run away. Therefore, it is considerably easier to start than prior artr free piston Stirling engines.

While certain preferred embodiments of the present invention have been disclosed in detail, it is to be understood that various modifications may be adopted without departing from the spirit of the invention or scope of the following claims.

We claim:

1. An improved free piston Stirling cycle engine of the type having a displacer and a piston reciprocating in a cylinder formed in a housing and having a working gas flow path from a hot space adjacent one end of the displacer to a cold space adjacent the opposite end of the displacer, wherein the improvement comprises:

(a) linkage means for being actuated in response to the excursion of the piston beyond a selected first amplitude; and (b) valve means in said gas flow path connected for actuation by the linkage means for restricting the flow path for the working gas between the hot space and the cold space in response to piston excursion beyond the selected amplitude.

2. An engine in accordance with claim 1 wherein the linkage means and valve means more particularly comprise:

a port through a wall of the cylinder, cooperating with the piston to form a spool valve, said port being axially positioned to be intercepted by an end of the piston at said selected first amplitude and forming one of said working gas flow path.

3. An engine in accordance with claim 2 wherein said port has an axial dimension which is selected so that it is completely blocked by a side wall of said piston when the piston excursion reaches a selected maximum excursion amplitude.

4. An engine in accordance with claim 1 wherein the linkage means and valve means more particularly comprise:

(a) a passageway through said piston from one of said spaces to a piston port through a side wall of the piston; and (b) a port through a wall of the cylinder and connected at one end of said working gas flow path, said cylinder port being axially positioned to be in registration with said piston port at the intermediate position of the piston, both of said ports having axial dimensions for restricting gas flow through the ports when said piston exceeds said selected first amplitude.

5. An engine in accordance with claims 1 or 2 or 3 or 4 wherein the interfacing ends of the displacer and piston are matingly contoured.

6. An engine in accordance with claim 5 wherein the displacer has a domed convex end and the piston has a concave end with a peripheral skirt.

7. An engine in accordance with claims 1 or 2 or 3, or 4, wherein a linear alternator is connected to the output of the engine.

8. A method for limiting the amplitude of the piston excursion of a free piston Stirlig cycle engine of the type having a piston, a hot space, a cold space and a gas flow path between the hot space and the cold space, the method comprising:

restricting said gas flow path in response to piston excursion beyond a selected first amplitude in order to impede the working gas flow between the hot space and the cold space.

9. A method in accordance with claim 8 and further comprising making the gas flow path increasingly more restricted as a function of increased piston excursion amplitude beyond said selected first amplitude.

10. A method in accordance with claim 9 wherein said gas flow path is completely blocked at a selected maximum piston excursion amplidue which is greater than said selected first amplitude.

11. A method in accordance with claim 10 wherein said selected first excursion amplitude is less than the excursion amplitude for the design maximum power output from the engine and wherein said maximum piston excursion amplitude is less than the amplitude at which the piston would collide with an end wall of the cylinder.

* * * * *